US005435254A

United States Patent [19]

Amey et al.

[11] Patent Number: 5,435,254

[45] Date of Patent: Jul. 25, 1995

[54] KIT FOR PRODUCING A TABLE, ESPECIALLY AN OFFICE DESK

[75] Inventors: Graham Amey, Durban; Fred Ruf, Sandton, both of South Africa

[73] Assignee: Fleischer Buro- und EDV-MobelSysteme GmbH & Co. KG, Bochum, Germany

[21] Appl. No.: 108,459

[22] Filed: Aug. 18, 1993

[30] Foreign Application Priority Data

Aug. 20, 1992 [DE] Germany ..... 9211152 U

[51] Int. Cl.[6] ..... A47B 57/00

[52] U.S. Cl. ..... 108/64; 108/50; 108/153; 248/188.1

[58] Field of Search ..... 108/64, 50, 153, 156, 108/157, 180; 248/188, 188.1

[56] References Cited

U.S. PATENT DOCUMENTS

| | | | |
|---|---|---|---|
| 4,094,256 | 6/1978 | Holper et al. | 108/50 |
| 4,366,758 | 1/1983 | Blecher | 108/64 |
| 4,731,918 | 3/1988 | Burghardt | 108/156 X |
| 4,732,088 | 3/1988 | Koechlin et al. | 108/64 |
| 4,852,500 | 8/1989 | Ryburg et al. | 108/50 X |
| 4,941,412 | 7/1990 | Engel | 108/156 |
| 5,083,512 | 1/1992 | Newhouse et al. | 108/50 |
| 5,144,888 | 9/1992 | Heine et al. | 108/64 |
| 5,163,373 | 11/1992 | Anderson et al. | 108/156 X |

*Primary Examiner*—Jose V. Chen

*Attorney, Agent, or Firm*—Herbert Dubno

[57] ABSTRACT

A kit for producing a higher versatile table, preferably an office desk in which the table is assembled from platform segments which are joined together and to the fastening plate of a leg by perforated plates having a hole pattern matching the hole pattern formed by threaded bores in the undersides of the platform segments, at least one leg being joined to the perforated plate via its fastening plate and the screws of the kit.

13 Claims, 5 Drawing Sheets

KIT FOR PRODUCING A TABLE, ESPECIALLY AN OFFICE DESK

FIELD OF THE INVENTION

The present invention relates to a kit, i.e. an assembly of elements, capable of producing a table in a highly versatile manner, i.e. with any of a number of possible configurations, and especially an office-type desk.

BACKGROUND OF THE INVENTION

Office desks, tables for office purposes and workstations generally may be desirable in various configurations, e.g. in an elongated, encircling or compact configuration and generally are defined for the intended configuration with a table surface of the desired configuration and pedestals and/or legs upon which the platform is mounted.

It is known, of course, to connect such platforms into workstations of various configurations, but generally each of the units of the workstations is independent from the others although connection between them may be effected by angles, brackets or links especially provided for this purpose. Generally, it is not possible to vary the configuration from the original design without, for example, redrilling the platforms or other members of the table structure.

Modular furniture elements including table structures are also available for assembly in various patterns, but usually each of these units is a free standing unit with some of the disadvantages of the other systems described.

OBJECTS OF THE INVENTION

It is therefore an object of the present invention to provide an improved a kit for the production of a table, especially an office desk, with a high degree of shape or configurational versatility, enabling workstations of various shapes to be made simply and rapidly.

Another object of the invention is to provide a kit for a table, especially an office desk which avoids the drawbacks of earlier modular and variable systems.

It is also an object of this invention to provide a table structure which can be assembled rapidly and in a variety of shapes.

SUMMARY OF THE INVENTION

These objects and others which will become apparent hereinafter are attained, in accordance with the invention in a kit or assembly of elements for the fabrication of a table or a table structure fabricated from such elements, wherein a plurality of plate segments, i.e. segments designed to be assembled in a common plane to form a table platform, for threaded bores on their undersides in a specific bore pattern which comprises units of four shaped apart threaded bores in the preferred configuration.

Legs are provided for the table or platform and have at their upper ends, connecting or fastening plates which also have bores in the aforementioned pattern so that these bores can register with the threaded bores.

The segments are connected together and the legs are connected to the plate segments through perforated plates which have holes in the aforementioned bore pattern so that these plates can bridge between platform segments or can be provided between the fastening plates of the legs and the underside of the platform segments, bolts or screws passing through the aligned holes and bores and being screwed into the threaded bores on the underside of the platform segments to connect the platform segments together and to connect the legs to the platform segments.

More particularly, a kit for producing a table, especially an office desk, can comprise:

a plurality of plate segments contiguously positionable to generate a multiplicity of table layouts, all of the segments being formed with an upper surface, a lower surface and, opening at the lower surface, a multiplicity of threaded bores in a predetermined hole pattern at least along a plurality of edges of each plate segment;

a plurality of table legs each formed at an upper end with a connecting plate having a plurality of bores spaced apart in the pattern and adapted to register with the threaded bores of the segments and, upon assembly of the segments in contiguous relationship, with at least one plate segments of a plurality of contiguously adjoining segments;

connecting means for bridging between contiguously adjoining plate segments and including perforated plates having multiplicities of holes in the predetermined hole pattern adapted to register with the threaded bores of at least two contiguously adjoining plate segments and with bores of the connecting plates; and bolts adapted to be screwed into the threaded bores and insertable in the holes in the perforated plates and simultaneously through the bores of the connecting plates and holes of the perforated plates where the legs are to be mounted to assemble the segments and legs into a table.

As a consequence, the plate segments which are assembled into the platform of the table need only be attached to the legs and to one another by perforated plates which are in the hole pattern of the bores of the underside of the table via respective screws.

Since the hole patterns are identical, a variety of configurations or variations in the platform shape are possible. Additional platform segments can be added to increase the working surface of the workstation and/or to vary the configuration thereof or to link one or more desks or tables together.

The legs can provide the stability required for the table and can be disposed wherever additional support for a particular segment or group of segments is required.

According to a feature of the invention, one of the platform segments is a delta shaped six sided segment having one transverse side or edge shorter than the opposite transverse side or edge. One of the inclined sides connected to the shorter transverse edge is longer than the inclined side or edge connected to the longer transverse side and to each of these longer inclined sides, a shorter inclined side can be connected.

In a particularly advantageous embodiment of the invention, such a delta shaped six sided segment can form the basic element of a table to which other segments can be connected, the other segments being generally rectangular, semicircular or combinations of rectangular and circular segments. The connection in each case is effected via one of the perforated plates described and appropriate screws. These segments in turn can be connected to other delta shaped six sided segments to produce a large area central station, a plurality of workstations connected to one another in a chain or a combination thereof.

In all cases, the connection of the platform segments to one another and to respective legs is rapid and simple and allows a high variability in the linking of the work surface to produce office desks and work stations.

According to a feature of the invention, the platform segments can be composed of pressed board, fiberboard, chip board or the like, with a cast peripheral frame of hardened synthetic resin, e.g. a hard polyurethane.

This construction allows relative stable, self-supporting platform segments to be made which, indeed, can have the character of steel. This is a sense of the fact that an especially intimate connection can be formed between the cast frame and the rough-surfaced chip board. The particle board can have melamine resin layers or veneer layers of real wood laminated to one or both sides.

The threaded bores in the platform segments are preferably formed as bores into which threaded inserts are fitted.

The mounting openings in the perforated plates and the connecting openings in the connecting or fastening plates can have formed as circular bores and/or as elongated holes or slots to allow, in spite of the identicalness of the hole patterns, screws to be fitted rapidly and easily through the aligned holes or bores.

The table legs or each table leg can, in accordance with the invention, have a central column to which the fastening plate is connected by bolts or screws. Advantageously, the central column is a four sided column provided at the corners of its cross section with notched profiles into which hood-like or duct forming cover profiles can be engaged to provide passages for electrical cables and the like.

In at least one of the central columns, at least one electrical outlet is provided, preferably with a switch, this column having a cable outlet or inlet at its foot. The central columns can be provided at their feet with level adjusting means and it is also possible to provide table feet so that they can be connected by screws or bolts to the central columns.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
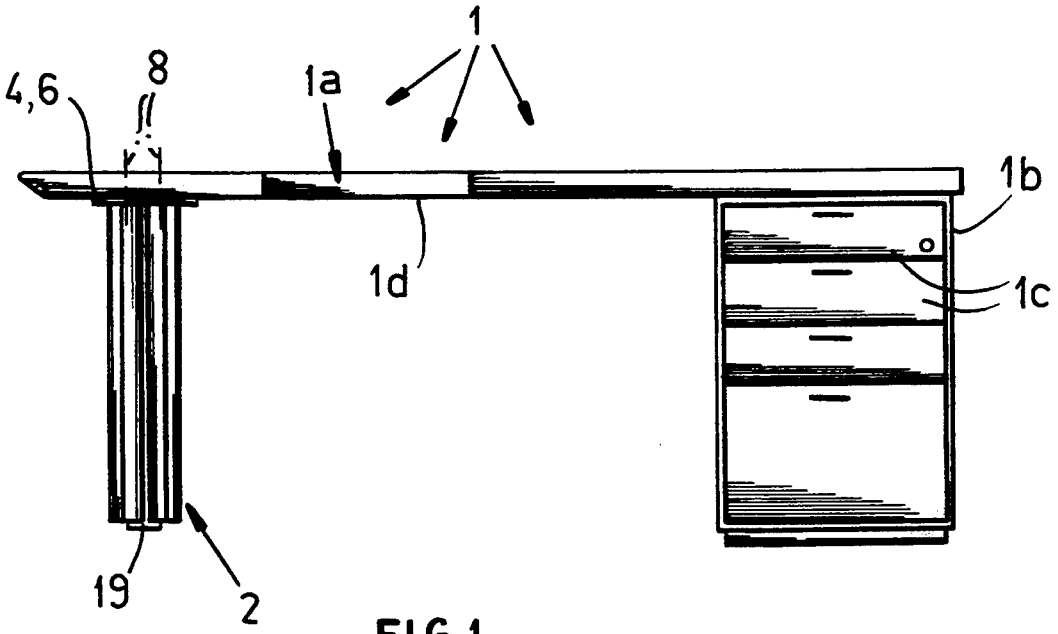
FIG. 1 is an elevational view of a table in the form of a pedestal desk, which can be assembled from the kit of the present invention.

From the drawing, it will be apparent that the basic elements for constructing a table generally and specifically an office desk or workstation, comprises a platform or table top 1*a* is subdivided into platform segments 1 which can be equipped with table legs 1 and can rest, if desired, on a pedestal 1*b* provided with drawers 1*c* if desired.

Figure 3:
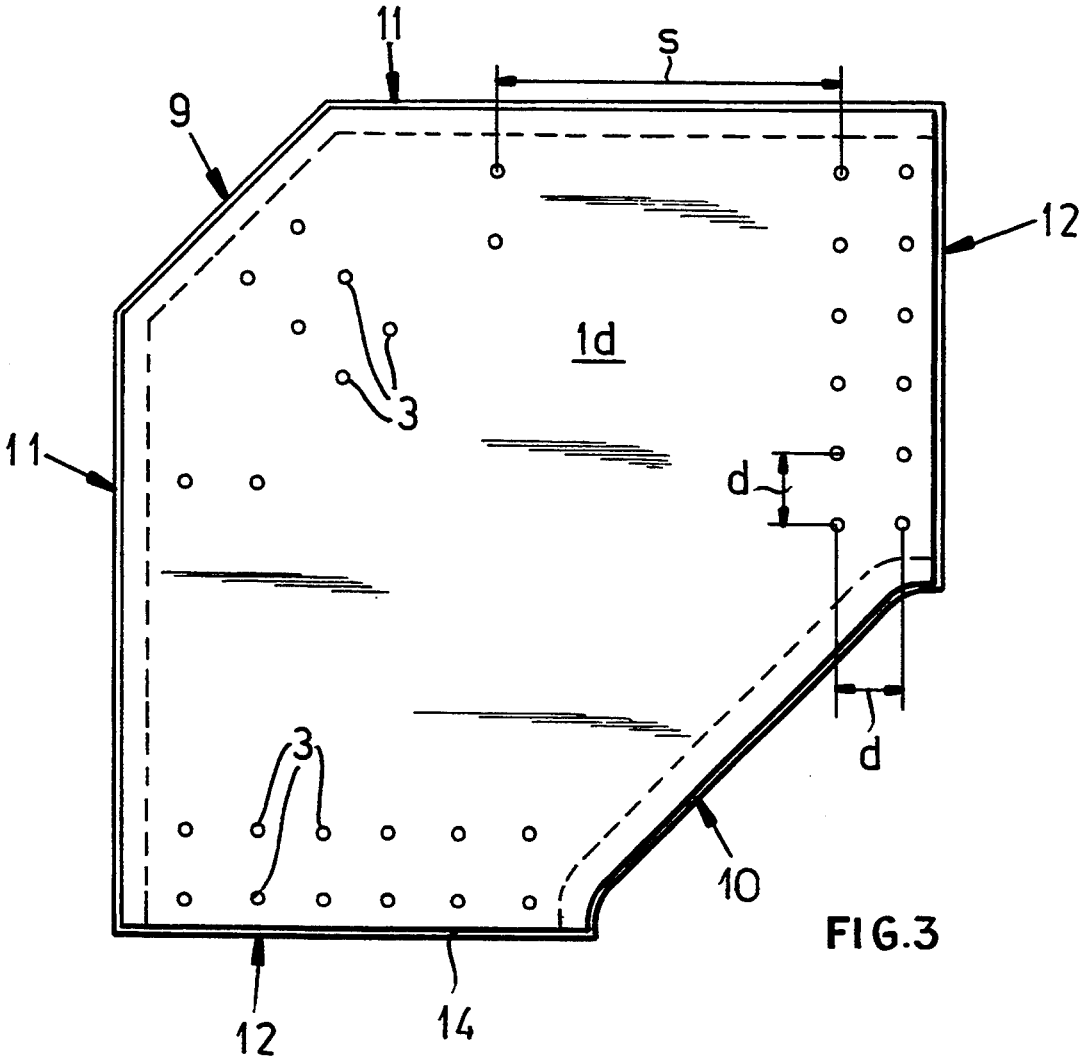
FIG. 3 is a bottom plan view of a delta shaped six sided platform segment in accordance with the invention.
Figure 5:
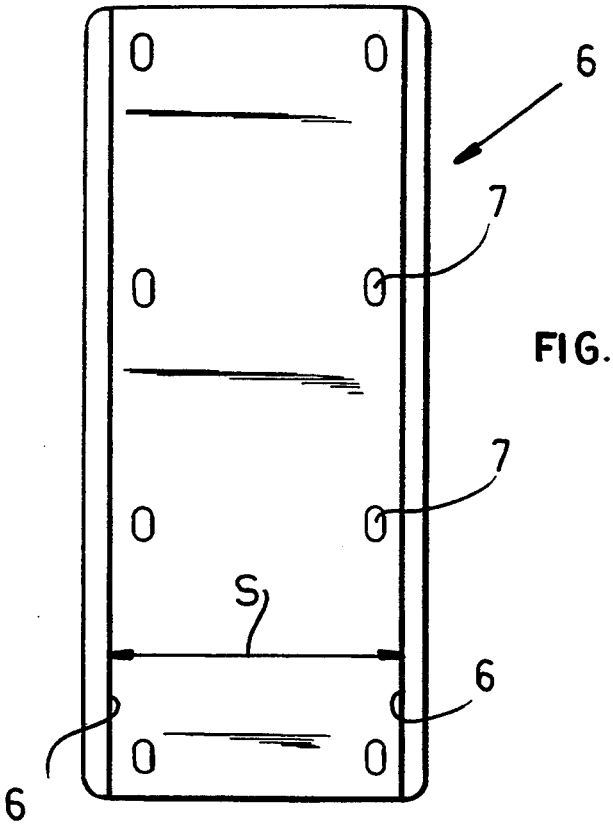
FIG. 5 is an elevational view of a perforated plate which can be used to connect the platform segments according to the invention and to connect the fastening plate of a leg to the underside of a platform segment.

The platform segments 1 as can be seen for the segment 1*d* shown also in FIG. 3, can have threaded bores 3 opening at the underside of the segments in a hole pattern which can provide for four holes at the vertices of a square, with equal spacings d. The spacings s between groups of holes can be a multiple of spacing d and all hole spacings are such that a perforated plate as shown in FIG. 5 can have its holes aligned with the holes of the respective patterns or grooves to span continuous platform segments across the connected edges thereof.

Each leg 2 is provided at its upper end with a connecting or fastening plate 4 with holes, bores or slots 5 in the identical hole pattern or spacing described.

The means for connecting the segments thus includes a perforated plate 6 with openings or holes 4, illustrated as elongated holes or slots 7, and screws or bolts 8 which can be threaded into the bores 3.

Figure 2:
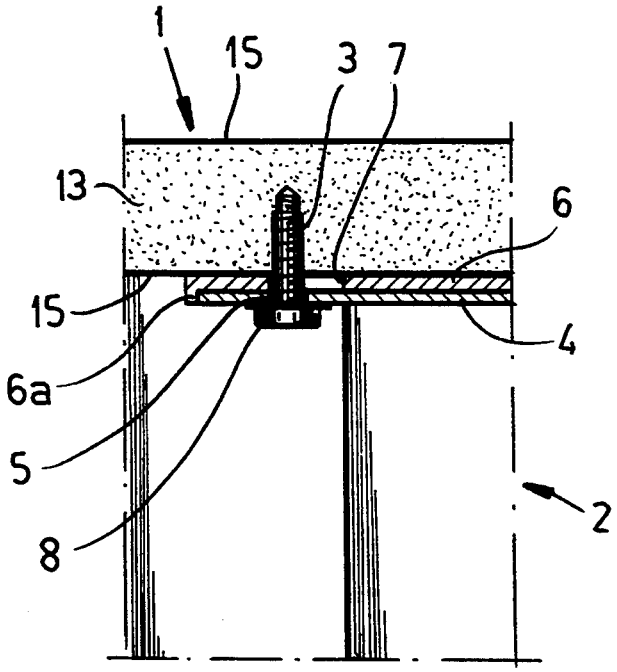
FIG. 2 is a vertical section through the table of FIG. 1 in the region of one platform segment, perforated plate and table.
Figure 6:
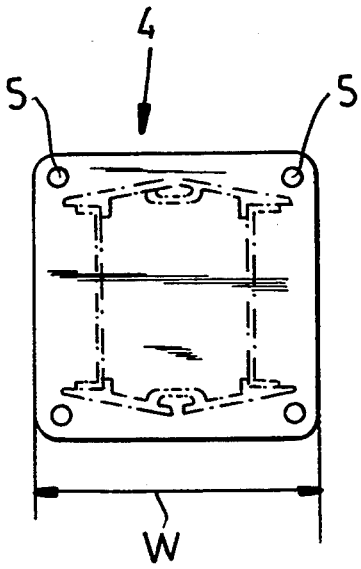
FIG. 6 is a top plan view of a fastening plate of a table leg.
Figure 7:
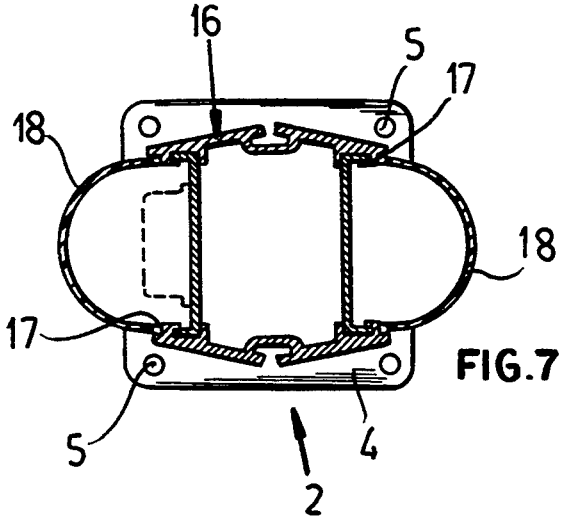
FIG. 7 is a diagrammatic cross section through a table leg showing the underside of the fastening or connecting plate thereof.

The segments 1 are mounted on the legs 2 via the plates 6 and the fastening plates 4 by the screws 8 as has been illustrated in FIG. 2. The perforated plates 6 have ridges 6*a* of a spacing S which can equal the length and width W of the fastening plates 4 (compare FIGS. 5 and 6).

With this assembly, a self-supporting table construction is formed as shown in FIG. 1.

One platform segment 1*d* has the configuration of a delta-shaped six sided member, one transverse side 9 of which (FIG. 3) is shorter than the opposite transverse side 10.

The inclined sides 11 connected to the shorter edge 9 are longer than the inclined edges 12 connected to the longer side 10, each longer side 11 being connected in turn to a shorter inclined side 12. The shorter inclined edges 12 are of equal length and the longer inclined edges 11 are of equal length.

Figure 4:
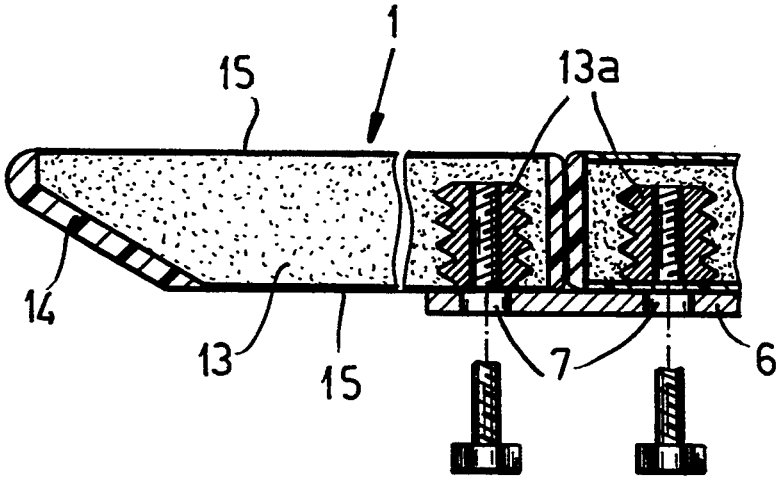
FIG. 4 is a partial section through the junction between two platform segments.

As has been shown in FIG. 4, the plate segments 1 are particle board plates 13 surrounded by a peripheral frame 14 which can be case from hard polyurethane in a closed mold.

The upper and lower surfaces of the particle board 13 can be bonded to melamine resin layers 15.

The threaded bores 3 in the platform segments can be formed by inserts 13*a* set into the particle board and composed of metal. That internally threaded members can receive the externally threaded screws or bolts 8.

The table legs 2 can have central columns 16 which, in cross section, can be provided with corner notches or profiles 17 into which hood-like cover profiles 18 can be releasably engaged. The fastening plates 4 can be attached to the central column 16 by screws (not shown).

The cover profiles or hoods 18 can define ducts through which electrical supply, telephone, computer, intercom and like cabling can pass. At least one electrical socket 16*a* can be provided in each central column. At the foot of each central column a level adjusting screw 19 can be provided.

Figure 9:
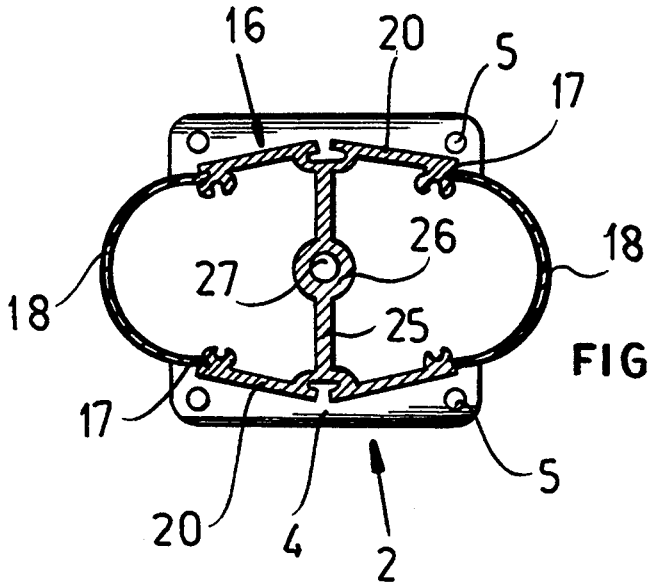
FIG. 9 is another cross sectional view through a table leg.
Figure 10:
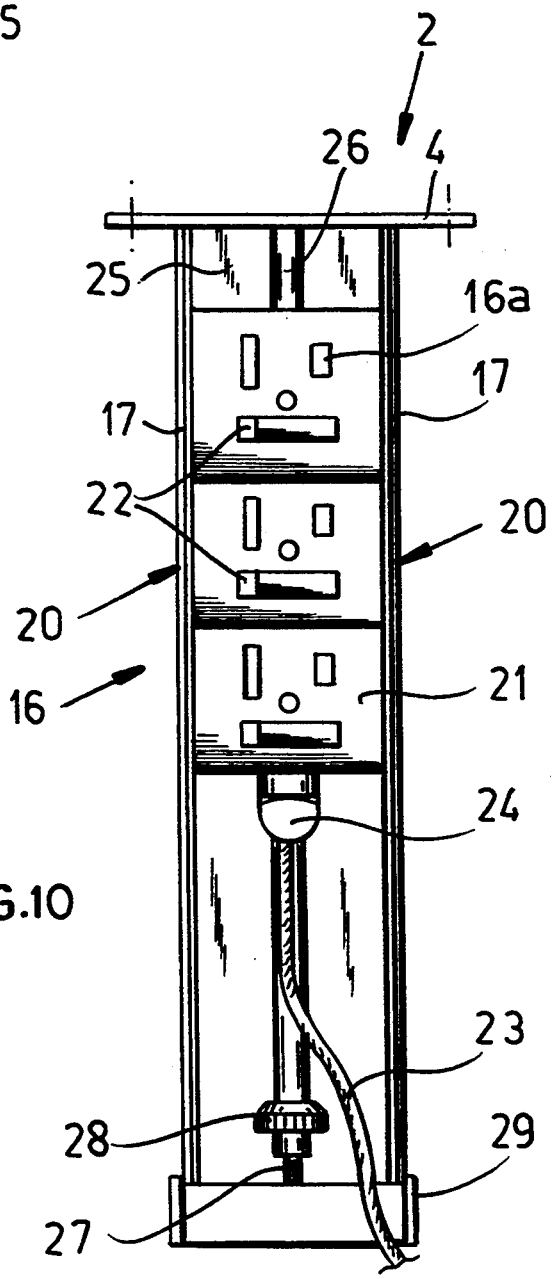
FIG. 10 is a front elevational view of the table leg of FIG. 10 showing one of the cover hoods removed.

In the embodiments shown in FIGS. 9 and 10, the central column 16 can have an I cross section with the flanges 20 being formed with notched profiles 17 into which the hoods or cover profiles 18 can engage to provide ducts through which the cabling can pass in this embodiment, an electrical outlet strip 21 can be provided with respective switches 22 controlling the individual outlets. Other electrical components can be mounted here as well.

At the foot of this central column, a cable passage is provided for the electrical cable 23 running to the outlet strip 21. The cable has a plug 24. The leg 2 in the embodiment of FIGS. 9 and 10 can be adjusted in height. For this purpose, the web 25 of the I-section central column 16 has vertical guides 26 for a threaded spindle 27 which can be moved upwardly and downwardly. The spindle cooperates with a spindle nut 28 which is fixed on the web 25. A cable foot 29 is connected to the spindle 27 so that rotation of the nut 28 will raise and lower the leg on the foot.

Figure 8A:
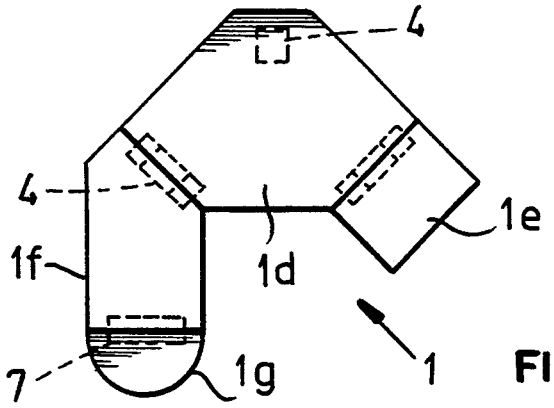
FIG. 8A, FIG. 8B and FIG. 8C are plan views showing layouts of different tables which can be assembled from the kit of the invention into respective workstations.
Figure 8B:
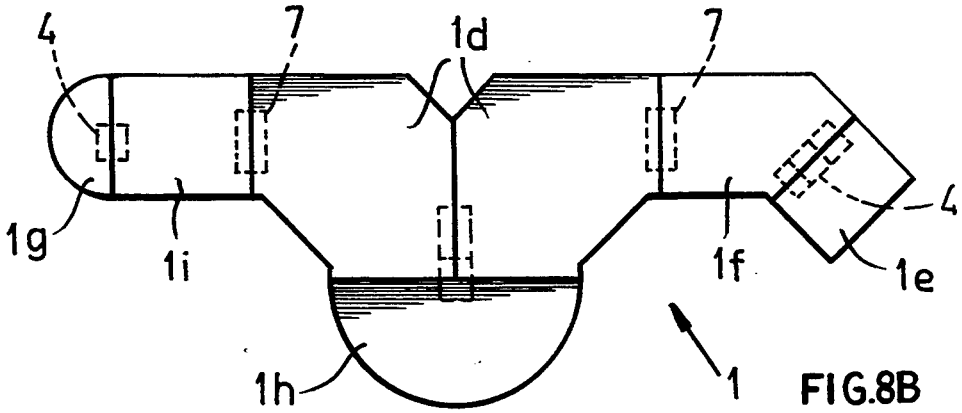

In FIG. 8A, we have shown a workstation in which one delta shaped segment is connected to a rectangular segment 1*e*, a segment 1*f* which is approximately pentagonal in shape and a segment 1*g* which is a semicircular segment connected to the segment 1*f*. In the embodiment of FIG. 8B, two delta shaped segments 1*d* are joined together and to a single semicircular segment 1*h*. One of these delta segments is attached to the segment 1*f* and 1*e* while the other delta shaped segment is attached to a rectangular segment 1*i* and the semicircular segment 1*g* previously described.

Figure 8C:
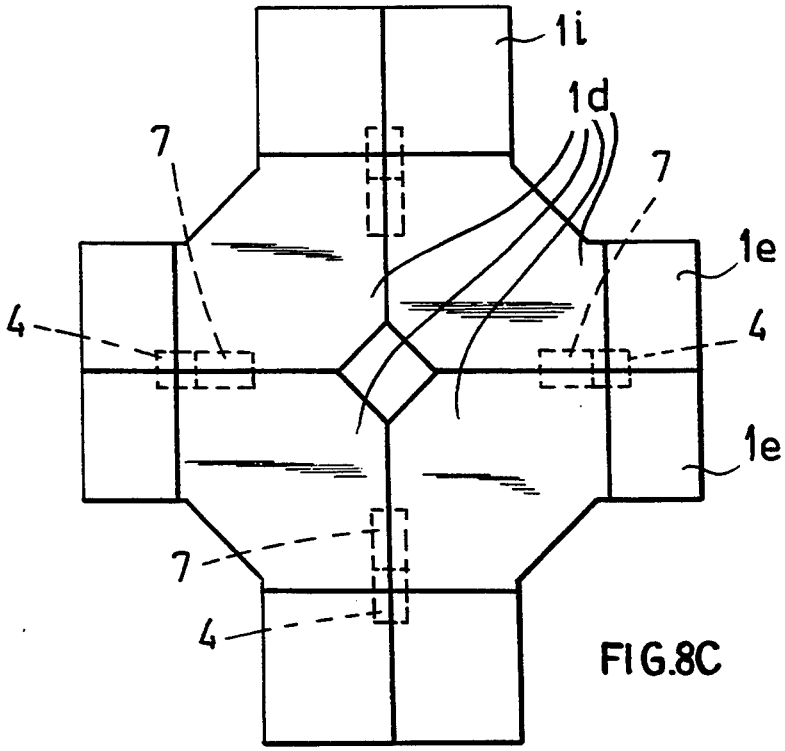

Four delta shaped segments 1*d* are joined together in the embodiment of FIG. 8C and each delta shaped segment is connected to a short rectangular segment and a long rectangular segment 1*i*. All of the segments 1*d* to 1*i* can be supplied with the kit.

The junctions between the segments are bridged by the plates 7 as shown and legs can be provided wherever a fastening plate 4 has been illustrated in FIGS. 8A–8C.

We claim:

1. A kit for producing a table, especially an office desk, comprising:

a plurality of plate segments contiguously positionable to generate a multiplicity of table layouts, all of said segments being formed with an upper surface, a lower surface and, opening at said lower surface, a multiplicity of threaded blind bores in respective predetermined multihole patterns at least along a plurality of edges of each plate segment;

a plurality of table legs each formed at an upper end with a substantially flat connecting plate having a plurality of throughgoing bores spaced apart in one of said patterns and adapted to register with the threaded bores of said segments and, upon assembly of said segments in contiguous relationship, with at least one plate segment of a plurality of contiguously adjoining segments at one of said patterns of said one of said segments;

connecting means for bridging between contiguously adjoining plate segments and including substantially flat perforated plates having multiplicities of throughgoing holes in said predetermined multihole patterns adapted to register with a plurality of said threaded bores each of at least two contiguously adjoining plate segments at respective others of said patterns thereof and with bores of said connecting plates; and bolts adapted to be screwed into said threaded bores and insertable in said holes in said perforated plates and simultaneously through said bores of said connecting plates and holes of said perforated plates where said legs are to be mounted to assemble said segments and legs into a table.

2. The kit defined in claim 1 wherein one of said segments is a delta-shaped six sided segment having one transverse side shorter than another transverse side opposite said one transverse side, two longer inclined sides extending from said shorter transverse side, and respective shorter inclined sides extending from said longer transverse side, the longer inclined sides being of equal length and connected to the shorter inclined sides, the shorter inclined sides being of equal length.

3. The kit defined in claim 1 wherein said segments are composed of particle board in a closed frame of a cast hard synthetic resin.

4. The kit defined in claim 3 wherein said hard synthetic resin is hard polyurethane and said segments have top and bottom surfaces composed of melamine resin layers or real wood veneer.

5. The kit defined in claim 1 wherein said threaded bores in said segments are formed by inserts embedded therein.

6. The kit defined in claim 1 wherein said holes in said perforated plate are elongated slots.

7. The kit defined in claim 1 wherein said legs each have a central column upon which the respective connecting plate is screwed.

8. The kit defined in claim 7 wherein each central column is four sided and is provided at corners with notches receiving edges of covered profiles defining respective cabling ducts.

9. The kit defined in claim 1 wherein said legs have I-cross section central columns, I-section flanges of said central columns being formed with notched profiles receiving cover profiles forming cabling ducts.

10. The kit defined in claim 1 wherein said leg is formed with at least one electrical outlet and a respective switch, said leg having at a bottom thereof, an outlet for electrical cable and a plug.

11. The kit defined in claim 1 wherein each leg has a central column provided with a threaded spindle, a nut being received on said spindle and being axially fixed with respect to said central column for adjusting a height of said leg.

12. The kit defined in claim 1, further comprising height adjustment means on said leg.

13. The kit defined in claim 1, further comprising a table foot adapted to be screwed to a central column of said leg.

* * * * *